US007455395B2

(12) United States Patent
Wilson et al.

(10) Patent No.: US 7,455,395 B2
(45) Date of Patent: Nov. 25, 2008

(54) SENSORS

(75) Inventors: Rhonda L. Wilson, Monmouth, OR (US); Craig Malik, Corvallis, OR (US); Norman E. Pawlowski, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 382 days.

(21) Appl. No.: 11/181,355

(22) Filed: Jul. 14, 2005

(65) Prior Publication Data

US 2007/0013752 A1 Jan. 18, 2007

(51) Int. Cl.
*B41J 2/175* (2006.01)

(52) U.S. Cl. ..... 347/85

(58) Field of Classification Search ..... 347/5, 347/7, 19, 85; 73/708, 714, 721, 754, 756
See application file for complete search history.

(56) References Cited

U.S. PATENT DOCUMENTS 4,111,058 A * 9/1978 Gross ..... 73/714
4,661,822 A 4/1987 Hirota et al.
5,116,331 A * 5/1992 Chapman ..... 73/721
5,502,467 A 3/1996 Hoisington et al.
6,224,198 B1 5/2001 Cook et al.
6,290,343 B1 9/2001 Lewis et al.
6,428,156 B1 8/2002 Waller et al.
6,435,638 B1 * 8/2002 Wilson et al. ..... 347/7
6,467,861 B1 * 10/2002 Thielman et al. ..... 347/6
6,648,434 B2 11/2003 Walker et al.
6,698,869 B2 3/2004 Vosahlo
6,811,249 B2 * 11/2004 DeVries et al. ..... 347/85
2002/0012016 A1 1/2002 Wilson et al.
2004/0085412 A1 5/2004 DeVries et al.
2004/0196339 A1 10/2004 Kobayashi et al.
2004/0215406 A1 10/2004 Hoen et al.
2005/0012791 A1 1/2005 Anderson et al.

* cited by examiner

*Primary Examiner*—Anh T. N. Vo

(57) ABSTRACT

Example embodiments of pressure sensors are illustrated and described.

12 Claims, 6 Drawing Sheets

SENSORS

BACKGROUND

In some applications where a fluid, such as ink, is deposited on a medium, the fluid may be stored in a reservoir prior to being deposited on the medium. Devices for determining an amount of the fluid in the reservoir in the past have been expensive to manufacture and cumbersome to use.

DETAILED DESCRIPTION

Figure 1:
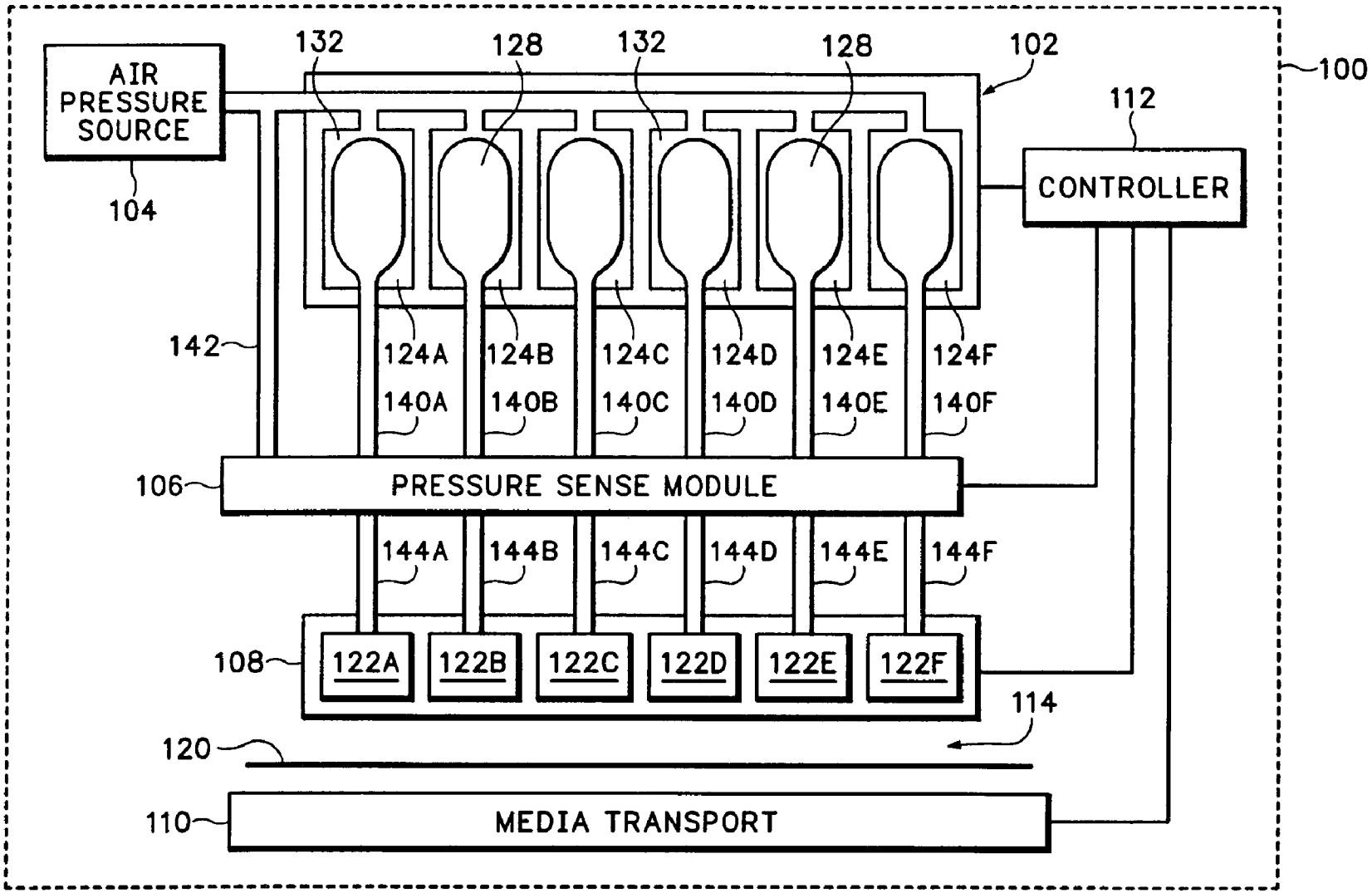
FIG. 1 schematically illustrates an imaging device in accordance with an example embodiment.

FIG. 1 illustrates an example embodiment of an imaging device 100. The device 100 may comprise, for example, a printer, a copier, a plotter, a multifunction device, or the like. The device 100 includes an ink supply station 102, an air pressure source 104, a pressure sense module 106, a print engine 108, a media transport system 110, and a controller 112.

The print engine 108 is coupled to the controller 112 and is configured to deposit ink or other suitable fluid onto a medium 120 under control of the controller 112. The medium 120 may be advanced through a print zone 114 by the media transport system 110 under control of the controller 112. The media transport system 110 may comprise rollers, belts, a drum, or other suitable mechanisms for advancing media in the device 100.

In particular, the print engine 108 is shown as including print cartridges 122A, 122B, 122C, 122D, 122E, 122F, collectively referred to as print cartridges 122. The print cartridges 122 may also be referred to as pens. The print cartridges 122 may be arranged in some embodiments as a page wide array of print cartridges that do not move significantly while depositing ink on the medium 120. In other embodiments, the print cartridges may be disposed on a carriage that moves the cartridges relative to the medium.

The print cartridges 122 are fluidly coupled to containers 124A, 124B, 124C, 124D, 124E, 124F, collectively referred to as containers 124. The containers 124 may be located at the ink supply station 102 as shown in FIG. 1. In this configuration, each of the print cartridges 122 is fluidly coupled to a corresponding one of the containers 124.

Each of the containers 124 includes a collapsible ink reservoir 128 within a pressure chamber 132. The air pressure source 104 is fluidly coupled to the pressure chambers 132 to pressurize the ink reservoirs 128. Thus, according to some embodiments, a single air pressure source 104 provides pressurized air to each of the chambers 132. The ink reservoirs 128 are in fluid communication with respective print cartridges 122 via conduits 140.

The pressure sense module 106 is disposed along the conduits 140 to sense pressure within the conduits. The controller 112 is coupled to the pressure sense module to obtain pressure data from the pressure sense module 106. As illustrated, the pressure sense module 106 is within the device 100 and is spaced from the ink supply station 102 and the print engine 108.

The air pressure source 104 provides pressurized air to the pressure sense module 106 via conduit 140. As such, the pressure sense module 106, in some embodiments, may perform differential pressure measurements by measuring the difference in pressure between the pressure delivered to the module 106 via conduit 142 and the pressure of each of the conduits 140.

Conduits 144A, 144B, 144C, 144D, 144E, 144F are in fluid communication, respectively, with conduits 140A, 140B, 140C, 140D, 140E, 140F. The conduits 144A, 144B, 144C, 144D, 144E, 144F are also in fluid communication with print cartridges 122A, 122B, 122C, 122D, 122E, 122F, respectively.

In some embodiments, the controller 112 is configured to obtain pressure data for one or more of the conduits 144 from the module 106. Using the pressure data obtained from the module 106, the controller 112 may determine, or estimate, an amount of ink in a reservoir 128 based on the differential pressure sensed at the corresponding conduit 140.

Since the pressure sense module 106 is separate from the ink supply station 102, the pressure sense module 106 and the components thereof are not typically replaced with replacement of empty reservoirs 128. Further, in some embodiments, cost savings may be effected by not including pressure sensors at the ink supply station 102. Moreover, by performing pressure sensing for multiple conduits in a single module, manufacturing costs may be reduced. Moreover, use of a pressure sensor to approximate an amount of ink remaining in an ink supply is further described in U.S. Pat. No. 6,454,375, the disclosure of which is hereby incorporated by reference. Additional features are illustrated in the figures and are described below.

Figure 2:
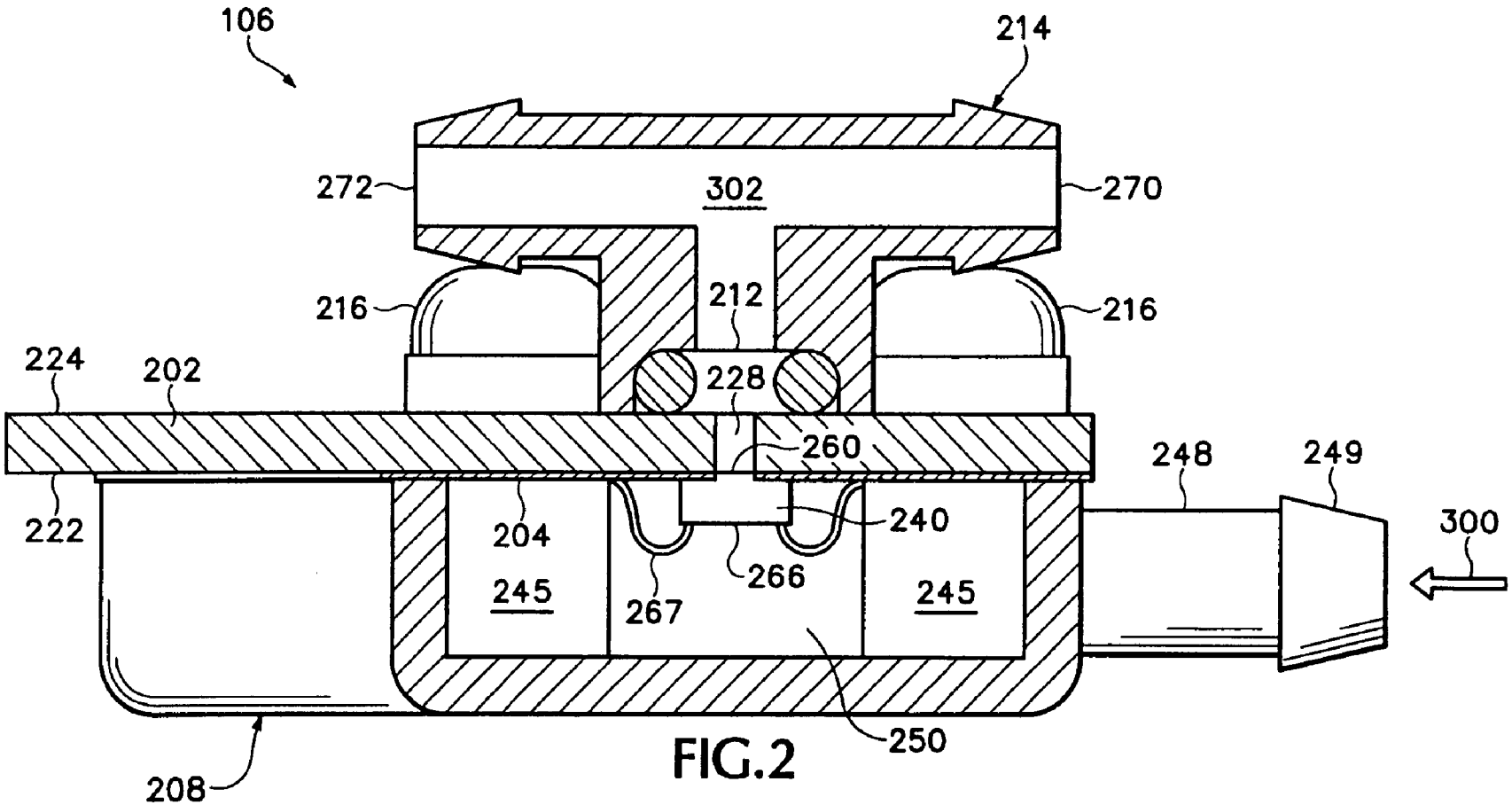
FIG. 2 is a sectional view of an example embodiment of a portion of a pressure sense module.
Figure 3:
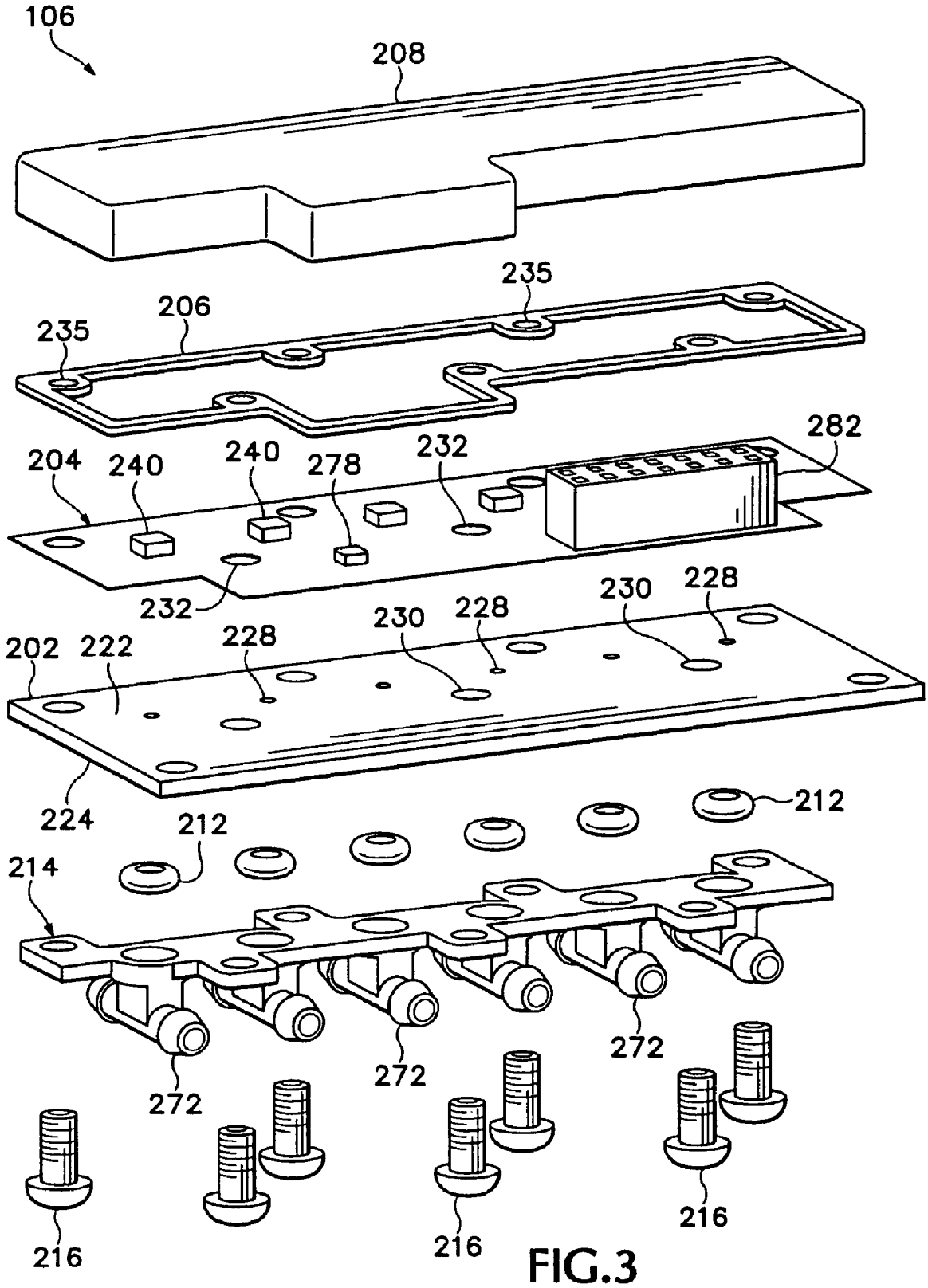
FIG. 3 is an exploded perspective view of an example embodiment of a pressure sense module.

FIGS. 2-7 illustrate an example embodiment of pressure sense module 106. With specific reference to FIG. 3, the pressure sense module 106 includes a substrate 202, a circuit 204, a gasket 206, and a cover 208. The pressure sense module 106 is also shown in FIG. 3 as including o-rings 212, a manifold 214, and fasteners 216.

The substrate 202 may comprise a ceramic substrate or a substrate formed of another suitable material. In some embodiments, the substrate 202 is substantially chemically inert and has a low coefficient of thermal expansion. The substrate 202 is shown as having surfaces 222, 224. The substrate 202 is also shown as having holes 228 formed between the surfaces 222, 224. The holes 228 are positioned to permit a differential pressure measurement. The substrate 202 also includes apertures 230 for receiving the fasteners 216. The fasteners 216, in some embodiments, may comprise screws.

The circuit 204 is shown as positioned at the surface 222 of the substrate 202. The circuit 204, in some embodiments, may comprise a flex circuit. The circuit 202 may comprise polyethermide or other suitable material with a pattern of copper circuitry formed thereon, such as by etching. In other embodiments, the circuit 204 may comprise a suitable printed circuit material, such as FR4 or the like.

Figure 4:
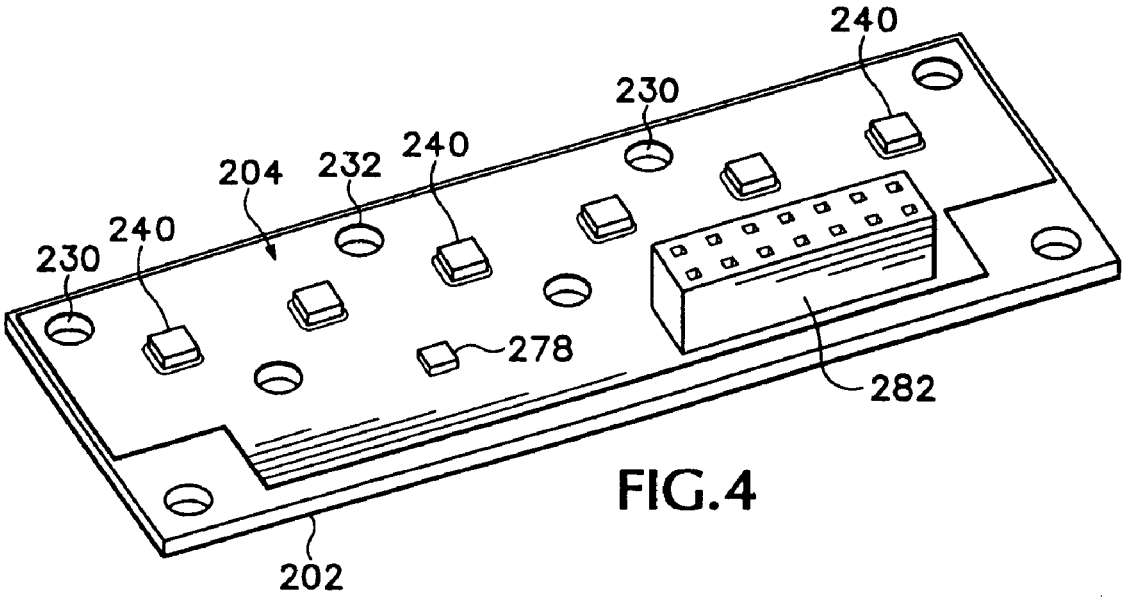
FIG. 4 is a perspective view of a portion of a pressure sense module according to an embodiment.
Figure 5:
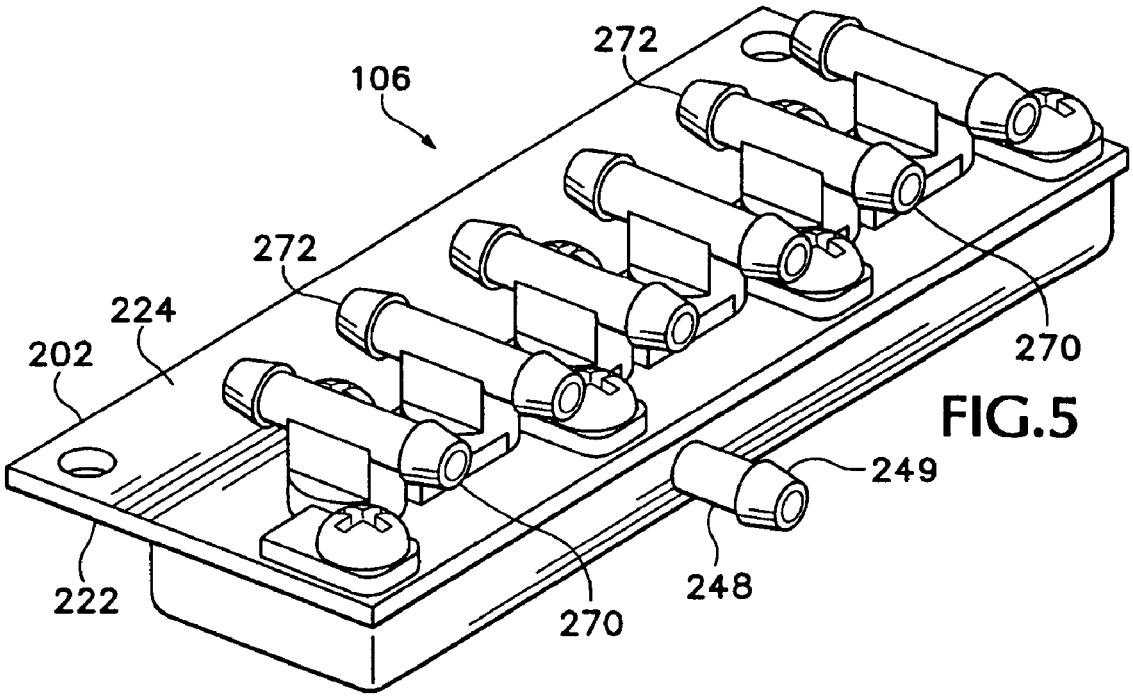
FIG. 5 is a perspective view of a portion of a pressure sense module according to an embodiment.
Figure 6:
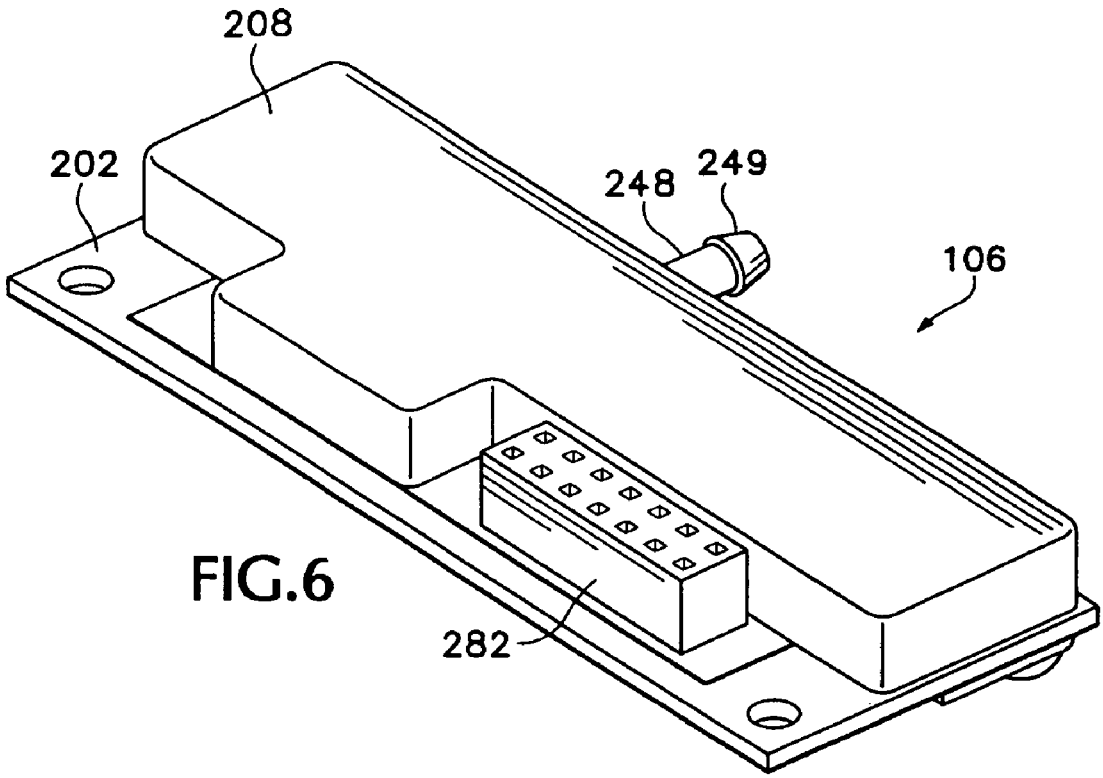
FIG. 6 is a perspective view of a portion of a pressure sense module according to an example embodiment.
Figure 7:
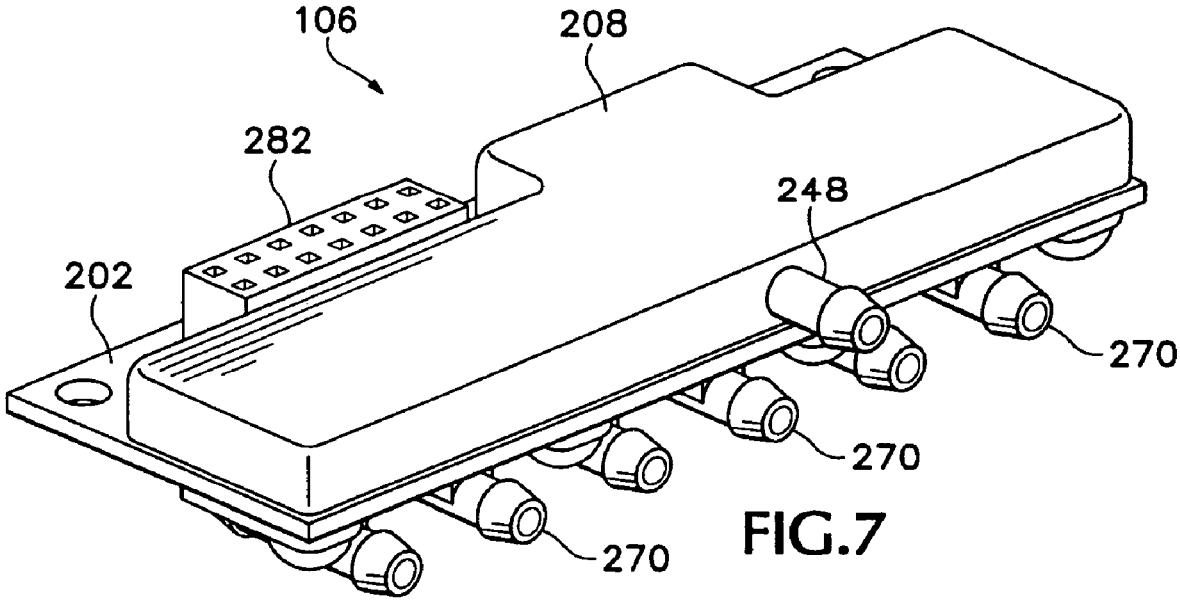
FIG. 7 is a perspective view of a portion of a pressure sense module according to an example embodiment.

Sensors 240 are shown as being mounted on the substrate 202 and connected to the circuit 204. In some embodiments, the sensors 240 may be wire bonded to the circuit 204. The sensors 240 may be bonded to the surface 222 of the substrate 202 by a suitable adhesive. In some embodiments, the adhesive used to bond the sensors to the surface 222 comprises a compliant adhesive that is relatively insensitive to changes in temperature and humidity. The sensors 240 are mounted on the substrate at holes 238. Moreover, as shown in FIG. 4, the circuit 204 may include openings 232 through which the sensors 240 contact the surface 222 of the substrate 202. The sensors 240 comprise pressure sensors and may be configured as differential pressure sensors to measure a pressure difference between the pressure at conduit 142 (FIG. 1) and a pressure in one of the conduits 140. As shown in FIG. 2, the sensors 240 include side 260 configured to be acted upon by ink passing from conduit 140 to conduit 144. The sensors 240 also include side 266 configured to be acted upon by a gas, such as air, within chamber 250 (FIG. 2).

The gasket 206 (FIG. 3) is positioned between the surface 222 of the substrate 202 and the cover 208. The gasket 206 may serve to provide a seal between the substrate 202 and the cover 208 to limit or prevent fluid, such as air, from leaking from inside the cover 208. Hence, the gasket 206, in some embodiments, may aid in establishing a pressure within the cover 208 that is significantly greater than atmospheric pressure. The gasket 206 also includes apertures 235 configured to permit passage of the fasteners 216 through the apertures 235 to the cover 208. The gasket 206 may be formed from an elastomeric material or other suitable material.

The cover 208 is coupled to the substrate 202 via the gasket 206 and covers the sensors 240. As shown in FIG. 2, the cover 208 may include bosses 245 configured to engage the fasteners 216 to compress the o-rings 212 and the gasket 206. In some embodiments, the cover 208 may be formed of plastic, although other suitable materials may be alternatively employed.

As shown in FIGS. 2 and 5-7, the cover 208 also includes a port 248. The port 248 is in fluid communication with an inner chamber 250 (FIG. 2) of the cover 208. The port 248 is shown as including a barb 249 to facilitate securing a conduit, such as conduit 142 (FIG. 1) to the port 248. The port 248 may, therefore, be coupled to a source of pressurized gas, such as air, to pressurize the inner chamber 250 of the cover 208. The sensors 240 are disposed in the chamber 250, according to some embodiments.

The manifold 214 provides connection locations for conduits 140, 144 (FIG. 1). As shown in FIG. 2, the manifold 214 is configured such that the ink passing from conduits 140 to conduits 144 acts on sides 260 of the sensors 240 while pressurized gas acts on sides 266 of the sensors 240. In particular, and as shown in FIG. 2, the manifold 214 may have a substantially T-shaped cross-section. The manifold 214 includes inlets 270, outlets 272, and passageways 302. The inlets 270 and outlets 272 may include barbs for facilitating coupling the inlets and outlets to conduits. The inlets 270 may be coupled to conduits 140 and the outlets 272 may be coupled to conduits 144. In this configuration, as ink passes from the reservoirs 128 (FIG. 1) to the print engine 108, the ink passes through conduits 140, through the manifold 214, through conduits 144 to the print cartridges 122. The sensors 240 sense the pressure of ink at the manifold 214 for each of the conduits 140, 144.

An o-ring 212 is associated with each of the sensors 240. The o-rings 212 are compressed as the fasteners engage the cover 208 to create a tight seal between the manifold 214 and the substrate 202. In some embodiments, however, the o-rings 212 may be omitted. In these embodiments, an adhesive pattern seals the manifold 214 to the substrate 202.

A memory 278 may also be included in the module 106. As shown, the memory 278 may be coupled to the circuit 204. In some embodiments, the memory 278 may comprise a non-volatile memory, such as EEPROM memory. The memory 278, in some embodiments, is configured to store and stores calibration information for multiple ones of the sensors 240. The memory 278 may also store zeroing information for multiple ones of the sensors 240. The calibration information may include information relating to the slope of the voltage/pressure curve for each sensor. The zeroing information may relate to the voltage output by a sensor when there is substantially zero pressure differential across the sensor. The information stored at the memory 278 may be obtained by the controller 112 (FIG. 1) via connector 282. In some example embodiments, the slope of the voltage/pressure curve is about 20 millivolt/psi. However, this value may vary considerably and different sensors may have significantly different curves. In the configuration described above, the sensors 240 in the module 106 may be calibrated as a unit. That is, the sensitivity of the sensors 240 and the amplification channel may be calibrated at substantially the same time and the calibration information (sensitivity, gain, and zero) may be stored at the memory 278. Details regarding a digitally compensated pressure ink level sense system and method are disclosed in U.S. Pat. No. 6,648,434, the disclosure of which is hereby incorporated by reference.

FIG. 2 illustrates an example sectional view of an embodiment of module 106. In FIG. 2, one of the sensors 240 is illustrated as being wire bonded to circuit 204 via wire bonds 267. Further, FIG. 2 shows port 248 receiving pressurized gas 300 to pressurize the inner chamber 250 of the cover 208. The pressure of the pressurized gas and thus the pressure of the chamber 250 in some embodiments will be substantially equal to the pressure at the pressure chambers 132 of the ink supply station 102 (FIG. 1). The pressure within the chamber 250 acts on the side 266 of the pressure sensor 240. A pressure within the manifold at passageway 302 acts on the side 260 of the pressure sensor 240 through the hole 228. As such, the pressure sensor 240 detects the difference in pressure between the pressure within chamber 250 and the pressure within passageway 302 of the manifold 214. In some embodiments, the sensor 240 comprises a semiconductor die that outputs a voltage signal proportional or based on the difference in pressure sensed by the sensor 240 at the sides 260, 266 of the sensor 240. This signal may then be transmitted to the controller 112 (FIG. 1).

Figure 8:
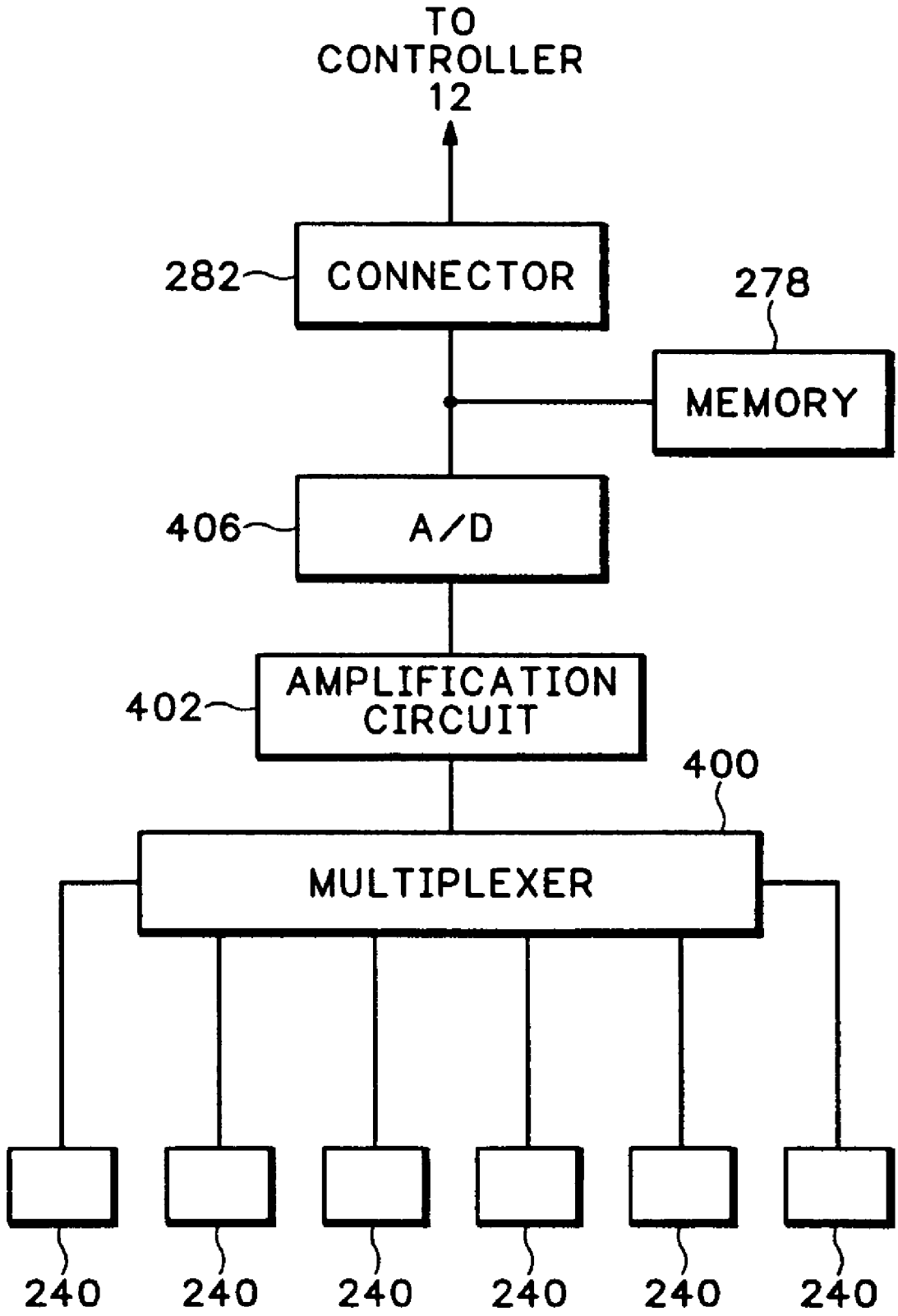
FIG. 8 schematically illustrates an example sensor configuration.

FIG. 8 schematically illustrates an example configuration of sensors 240, a multiplexer 400, an amplification circuit 402, memory 278, and a connector 282. In the embodiment of FIG. 8, the sensors 240 are electrically coupled to the multiplexer 400, which multiplexes the outputs of the various sensors 240 onto line 404. The amplification circuit 402 is configured to receive the signal at line 404 and to amplify this signal for transmission to the controller 112 via the connector 112. The analog output of from the amplification circuit 402 at line 408 may be converted to digital output by an analog-to-digital (A/D) converter 406. The output values of the A/D converter 406 are proportional to an associated pressure measurement by one of the sensors 240. Based on the output from the module 106, the controller 112 may make determinations regarding ink levels in associated reservoirs 128. In some embodiments, the controller 112 (FIG. 1) addresses individual ones of the sensors 240 to obtain output of the individual ones of the sensors 240. Moreover, in some embodiments, the sensor signals are low-voltage and may be susceptible to noise, transmission loss, or both. As such, by integrating the amplification 402 on the circuit 204 the sensor signals may be amplified at the circuit 204 and before transmission to the controller. Also, including the A/D converter 206 at the circuit 204 permits the sensor output to be sent to the controller digitally, which may reduce errors associated with noise and transmission losses.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. The present disclosure described with reference to the example embodiments and set forth in the following claims is manifestly intended to be as broad as possible. For example, unless specifically otherwise noted, the claims reciting a single particular element also encompass a plurality of such particular elements.

We claim:

1. A device, comprising:

a plurality of ink reservoirs;

a pressurized gas source configured to pressurize one or more of the ink reservoirs;

a plurality of printheads coupled to the ink reservoirs via conduits;

a module including a plurality of pressure sensors disposed on a single substrate, individual ones of the pressure sensors in fluid communication with individual ones of the conduits for sensing pressure within the conduits; and a pressurized gas line for providing pressurized gas from the pressurized gas source directly to the module, wherein the module measures a pressure differential between pressure within the pressurized gas line and pressure within the conduits.

2. The device of claim 1, further comprising a memory at the substrate, the memory configured to store calibration information for multiple ones of the pressure sensors.

3. The device of claim 1, further comprising a flex circuit at the substrate, the pressure sensors wire bonded to the flex circuit.

4. The device of claim 1, wherein the substrate includes apertures, the pressure sensors positioned at the apertures.

5. A print engine, comprising:

hoses for delivering marking fluid from reservoirs to the print engine;

sensors in fluid communication with the hoses for sensing pressure within the hoses, the sensors mounted on a common substrate;

a source of pressurized gas in fluid communication with the reservoirs and in fluid communication with the sensors;

a multiplexer for multiplexing output of the sensors; and a controller configured to receive data from the multiplexer, wherein a pressure differential is measured between a pressure at the sensors and the pressure within the hoses.

6. The subject matter of claim 5, further comprising a memory disposed on the substrate, the memory including calibration data for the sensors.

7. The subject matter of claim 5, wherein the sensors comprise differential pressure sensors disposed at apertures formed in the substrate.

8. The subject matter of claim 5, further comprising an amplification circuit coupled to the sensors.

9. The subject matter of claim 5, further comprising an A/D converter coupled to the multiplexer.

10. The subject matter of claim 5, further comprising conduits for communicating the source of pressurized gas with the reservoirs, and a conduit for communicating the source of pressurized gas directly with the sensors.

11. An apparatus, comprising:

a print engine configured to receive ink from reservoirs via conduits;

means for pressurizing the ink in the reservoirs;

means for sensing pressure within the conduits, the means for sensing pressure within the conduits being disposed on a single substrate; and means for measuring a pressure differential between the means for pressurizing the ink in the reservoirs and the pressure within the conduits.

12. The apparatus of claim 11, further comprising the means for measuring a pressure differential being disposed on the single substrate.

* * * * *